United States Patent [19]

Scott

[11] Patent Number: 4,951,983

[45] Date of Patent: Aug. 28, 1990

[54] LOCKING APPARATUS FOR CASES

[76] Inventor: James A. Scott, 1002 S. Chantilly, Anaheim, Calif. 92806

[21] Appl. No.: 299,172

[22] Filed: Jan. 19, 1989

[51] Int. Cl.[5] ..... F05C 5/00

[52] U.S. Cl. ..... 292/66; 292/113; 292/123; 292/97

[58] Field of Search ..... 292/11, 36, 48, 26, 292/63, 64, 66, 69, 110, 113, 97, 109, 123, 129, 104, 111, DIG. 72, DIG. 49, 286, 296, 247; 220/324, 325, 326, 327, 328

[56] References Cited

U.S. PATENT DOCUMENTS

| | | | |
|---|---|---|---|
| 1,913,966 | 6/1933 | Walter | 292/DIG. 72 |
| 2,605,123 | 7/1952 | Claud-Mantle | 292/113 |
| 2,751,240 | 6/1956 | Claud-Mantle | 292/113 |
| 2,939,734 | 6/1960 | Claud-Mantle | 292/247 |
| 2,954,252 | 9/1960 | Carpenter | 292/110 |
| 3,026,133 | 3/1962 | Swanson | 292/247 |
| 3,070,396 | 12/1962 | Swanson | 292/247 |
| 3,174,784 | 3/1965 | Swanson | 292/113 |

*Primary Examiner*—Eric K. Nicholson
*Attorney, Agent, or Firm*—Kenyon & Kenyon

[57] ABSTRACT

The disclosure relates to a locking mechanism for cases, a large portion of which is contained for operation within a recess located in the lower portion of the case. The locking mechanism includes a latch member for engaging a keeper on the upper portion of the case. A lever length arrangement cooperates with a sliding plate to actuate the latch between locked and unlocked disposition. A spring is secured to the hinge between the latch and the sliding plate to bias the latch toward an unlocked position such that when the lever is moved to an unlocked position the latch will automatically disengage the keeper.

21 Claims, 5 Drawing Sheets

LOCKING APPARATUS FOR CASES

BACKGROUND AND DISCUSSION OF THE INVENTION

There are a number of locking mechanisms presently in the marketplace for securing the top portion to the bottom portion of a case or container. However, many of these locking systems are relatively complicated, detracting from their use over long periods of time and rendering them relatively expensive to manufacture. In addition a number of interlocking parts extend substantially beyond the surface of the case to be locked. This detracts from the ability of the case to be stacked or otherwise arranged for shipping.

Examples of these devices are shown in U.S. Pat. No. 3,888,528 issued to Jericho, entitled a "Hatch Battening Device". The Jericho patent relates to a battening device for cargo hatches employing a hydraulically operated hook for engaging a pin on the hatch. The hook member is articulated to an upper end of a link, the lower end of which is articulated to the free end of a pivotally mounted arm. The upper end of the link is slidingly guided in an essentially vertical guide member on the coaming. With this arrangement, the hook portion of the hook member, after completion of the circumscribing movement of the hook member, effects a vertical movement downward toward the hatch pin.

Another patent of interest is U.S. Pat. No. 2,339,537 issued to Wise and entitled "Rear Luggage Compartment Lock". The Wise patent discloses a lock that will draw the lid tightly shut and at the same time, when the lock is released, will draw up and out of the way and retreat beyond the edge of the lid. The lock operates by means of pin and cam slots effecting disengagement from the keeper member. Operation of the mechanism includes a pin moving along a curved portion of a cam and causing movement of the locking arm to a completely raised position. A substantial portion of the movement is in a plane perpendicular to the plane of a case or other elements being locked.

Applicant's invention as described herein has overcome the problems noted above. In this invention a keeper is arranged on the lower portion of the top of a case to cooperate with the lever, which is secured in the dish or recess in the bottom portion of the case. The mechanism includes a spring to bias the latch toward a disengaged position. A sliding plate having a slot therethrough circumscribes a post to define the path of movement for the plate. The lever has one end pivotally fixed to the post and another end exposed for actuation by the user. A link has one end pivotally secured to an eccentric position approximately midway along the length of the lever and its other end pivotally secured to an end of the plate remote from the slot. With this configuration, when the lever is in an open position the sliding plate is in an upward, unlocked position. As the lever is rotated clockwise, movement of the link will force the sliding plate downwardly such that the latch will be locked into the keeper. To unlock the mechanism, the lever is simply rotated in a counter-clockwise direction which effects movement of the sliding plate upwardly, permitting the latch to disengage the keeper.

The above has been a brief discussion of deficiencies in the prior art and advantages of the invention described herein. Other advantages will be appreciated by those skilled in the art from the detailed discussion of the preferred embodiment which follows.

DETAILED DISCUSSION OF THE PREFERRED EMBODIMENT

Figure 1:
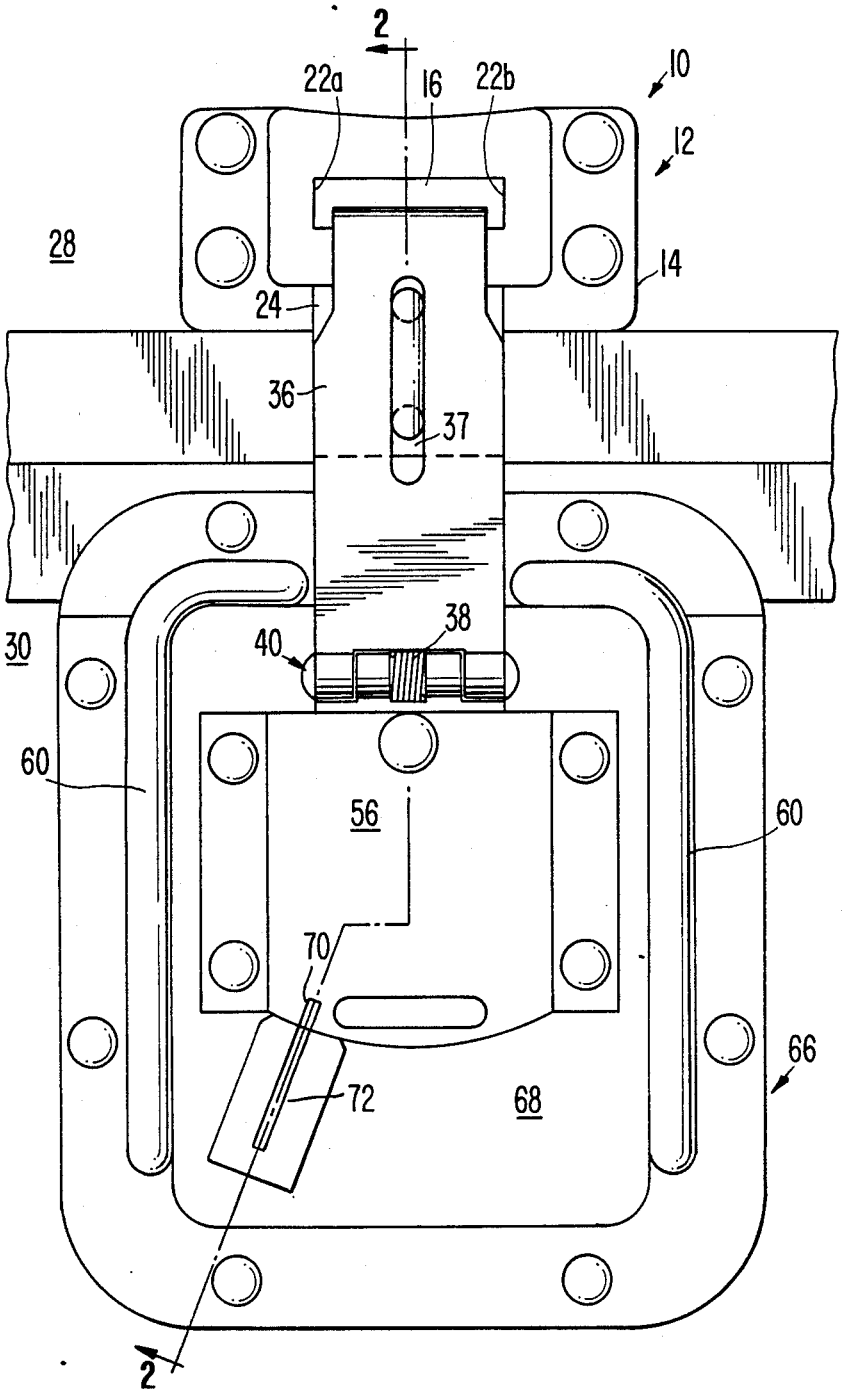
FIG. 1 is a plan view of a locking mechanism of the invention.

As can be seen in FIG. 1 the latch assembly 10 includes a keeper 12 generally characterized by relatively flat plate 14 having a slot 16 extending entirely therethrough. As more clearly shown in FIG. 2, the slot is formed by a lower lip 18 which projects outwardly slightly from the underlying case surface for engagement by latch 36. Cam surface 20 forms the opposed surface of slot 16 and cooperates with the latch to force the hook 62 of latch 36 into interlocking engagement with lip 18 during actuation which will be described below.

The length of the slot as defined by opposed intermediate edges **22*a* and 22*b* is greater than that of the width of hook 62 of latch 36 to accommodate slight movement of latch 36 during actuation. A lock plate 24 in this preferred embodiment extends downwardly from keeper 12 and supports lock loop 26** to provide a means for locking the mechanism in a secured position.

Keeper 12 is fixed to upper portion or top 28 of the case by a number of rivets as shown. The actuating mechanism 34 is secured to a dish 66 which is also riveted to lower portion or bottom 30 of the case in opposed relationship to the keeper.

Latch 36 is hingedly secured at hinge 40 to valence or sliding plate 44. The valence 44 defines a valence slot 46 which as shown is generally vertical and circumscribes post 48 to define a vertical path of movement between a locked and unlocked position for the valence 44. A link 50 has a first end connected to eccentric pivot 52 on lever 42 and a second end remote from said first end pivotally secured to valence 44 at a position at pivot 54 remote from valence slot 46. The length of slot 46 is sufficient to permit travel of the valence and latch assembly between the open and closed position to secure hook of lock plate over the lip 18 of keeper 12 and permit disengagement upon movement to an unlocked position. Spring 38 is secured in hinge 40 to bias the latch or lock plate 36 in an unlocked position such that when moved to an unlocked disposition it will automatically spring outwardly and disengage keeper 12.

A cover plate 56 is arranged to cover a substantial portion of the link 50, lever 42, and valence 44 as shown in FIG. 1. A portion of lever 42, handle 64, is exposed for actuation by the user. This entire mechanism fits within protective dish 66 recessed into lower portion 30 of the case. Recessed portion 68 of dish 66 is surrounded in part by opposed ridges 60 to protect the mechanism from damage during stacking and shipping.

Figure 2:
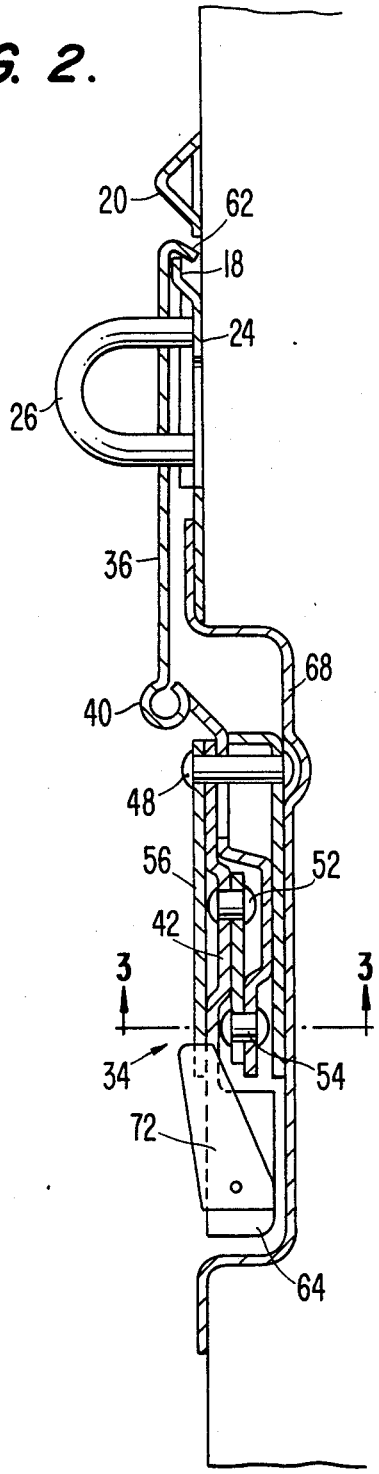
FIG. 2 is a cross-sectional view of FIG. 1 taken along lines 2—2.
Figure 3:
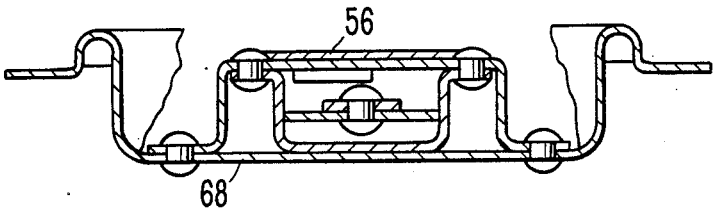
FIG 3 is a cross-sectional view of FIG. 2 taken along lines 3—3.
Figure 6:
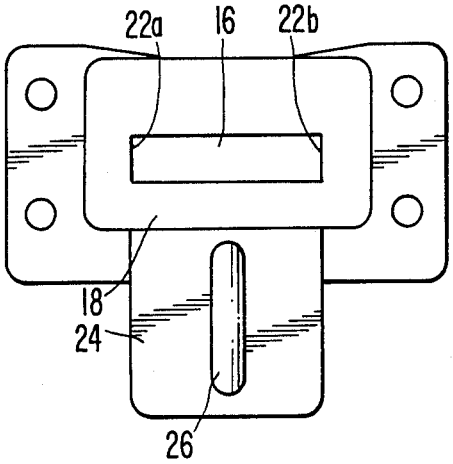
FIG. 6 is a plan view of the keeper used in the invention.

A locking mechanism is included to secure the latch 36 in the locked disposition. This mechanism includes a slot 70 in the cover plate and locking member 72 on handle 64 for sliding into slot 70 when moved in the locked position, as can be seen in FIGS. 1 and 2.

Figure 4:
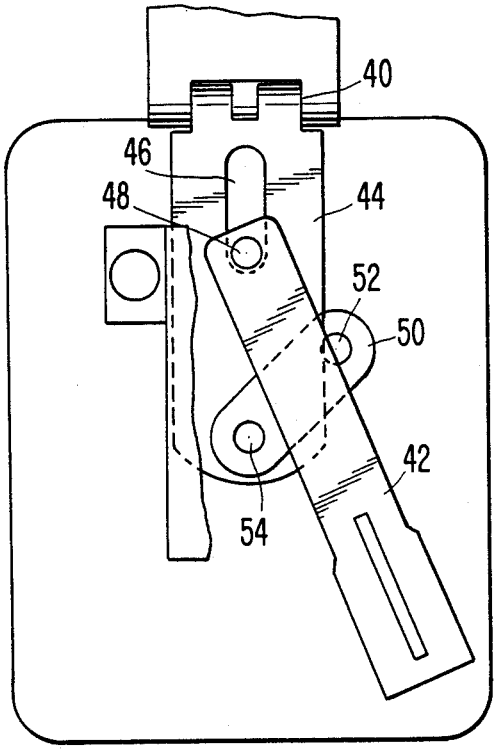
FIG. 4 is a partial cutaway view of FIG. 1 with the locking mechanism in an unlocked position.
Figure 5:
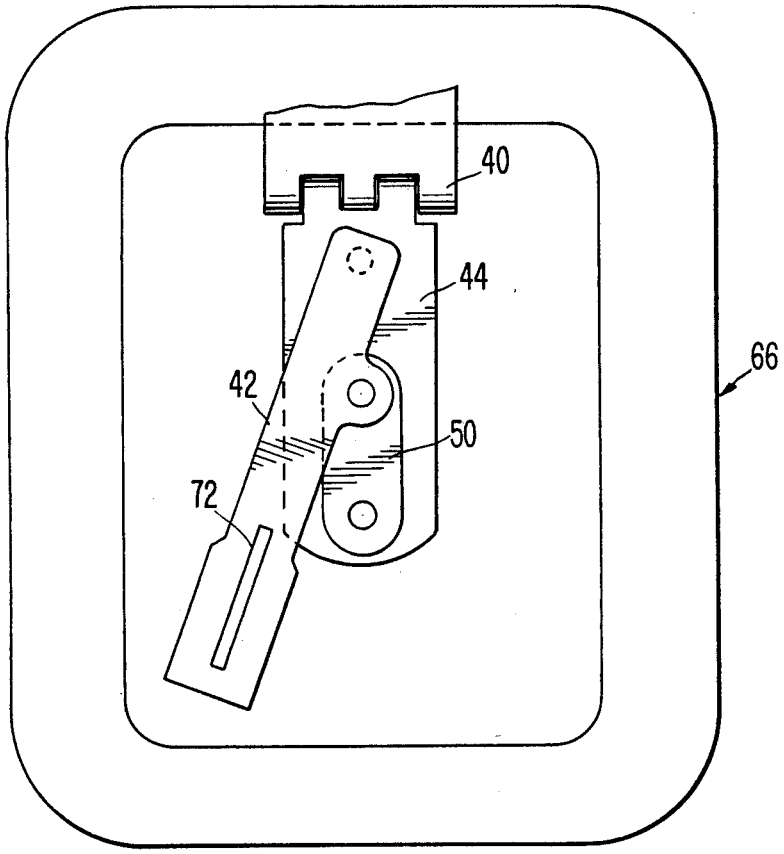
FIG. 5 is a partial cutaway view of FIG. 1 with the locking mechanism in a locked position.

In operation, before the upper or top portion 28 is secured to bottom portion 30, lever 42 is in the open or unlatched position a shown in FIG. 4. In this position latch 36 is extending outwardly and displaced out of the plane of the two portions of the case being latched together. Valence 44 is then moved toward keeper 12 such that the hook 62 engages the cam surface 20 on the rear side of keeper 12 and lock loop 26 extends through latch slot 37. The lever is then moved clockwise to the locked position. This actuation of the lever, through the interaction of the linkage, moves the sliding plate downwardly in a path defined by valence slot 46 and post 48. This downward movement forces hook 62 into engagement with lip 18 as shown in FIGS. 1 and 2. The locking member 72 is then placed in engagement with the slot 70 on the coverplate to lock the mechanism in a latched disposition.

The arrangement and operation as discussed above maintains the latch in a covered disposition and ensures that a substantial portion of the locking mechanism does not extend beyond the plane of the upper and lower portions of the container. It should be noted in this latched position that the longitudinal axis of the link 50 is generally colinear with that of the sliding plate 44 to ensure its maximum movement towards the latching position.

To unlatch the upper and lower portions of the container, the locking member 72 is removed from slot 70 in the cover plate to permit the lever to be moved to an unlatched position. The lever 42 is then rotated counterclockwise to the position shown in FIG. 4. This moves the link 50 in such a manner that it rotates about the pivot points to move the sliding plate upwardly to the unlatched position. Upon disengagement of the lip 18 with the keeper 12, the spring automatically biases the latch out of engagement through a plane perpendicular of that of the upper and lower portions.

The above description of the locking mechanism is in connection with a dish, preferably made of metal such as steel, that is zinc coated. The locking mechanism, however, can be made from high density plastic as well and without the need for the dish.

The above has been a detailed description of the preferred embodiment of the invention. The full scope of Applicant's invention is defined in the claims which follow and equivalent thereof. In this regard the specification should not be interpreted to unduly narrow the scope of invention to which Applicant is entitled.

What is claimed is:

1. A locking mechanism for locking an upper portion of a container to a bottom portion of the container comprising:

(a) a sliding plate being slidingly coupled to said bottom portion for movement toward and away from said upper portion;

(b) a lever being pivotally fixed to said bottom portion and oriented such that it substantially overlaps said sliding plate;

(c) a link having a first end pivotally secured to said lever and a second end pivotally secured to said sliding plate;

(d) a latch having a latch end and a hinge end, said hinge end being hingedly secured to said sliding plate;

(e) an engaging member being fixed to said upper portion and having a configuration complementary to the latch end of said latch for releasably engaging said latch end;

(f) said lever being rotatable between an open and a closed position, said link and said sliding plate cooperating with said lever to move said latch into locking engagement with said engaging member when said lever is moved to a locked position and to move said latch out of engagement with said complementary engaging member when said lever is moved to an unlocked position.

2. The locking mechanism according to claim 1 further comprising a biasing means for biasing said latch toward disengagement from said complementary engaging member.

3. The locking mechanism according to claim 2 wherein said complementary engaging member includes a keeper plate with a slot and said latch including means for engaging the portion of the plate defining said slot.

4. The locking mechanism according to claim 3 wherein said keeper plate includes a lip extending beyond a plane of the keeper plate, said lip defining one part of said slot and said latch including a hook at its latch end for engaging said lip.

5. The locking mechanism according to claim 4 further comprising means for locking said latch member to said upper portion of said container.

6. The locking mechanism according to claim 5 wherein said locking means includes a hook loop extending from said upper portion beneath said plate and a latch slot extending entirely through said latch member for permitting said lock loop to extend therethrough.

7. The locking mechanism according to claim 6 further comprising a post, said lever being rotatably secured to said post, and means for constraining movement of said sliding plate along a selected path toward and away from said keeper plate, said lever cooperating with said sliding plate to move said sliding plate toward said keeper plate when in an unlocked position and away from said keeper plate in said locked position to effect unlocking and locking of said latch with said keeper plate respectively.

8. The locking mechanism according to claim 7 wherein said means for constraining movement inludes a slot formed in said sliding plate and surrounding said post.

9. The locking mechanism according to claim 8 wherein the first end of said link is pivotally secured to said lever at a position spaced from said post and the second end of said link is pivotally secured to said sliding plate at a position remote from said slot.

10. The locking mechanism according to claim 9 wherein said lever has a pivot end pivotally secured to said post and a distal end remote therefrom for engagement by the user, the first end of said link being secured to said lever at a position spaced from a longitudinal axis of said lever between said post and said distal end.

11. The locking mechanism according to claim 10 further comprising a cover plate for covering at least a portion of said sliding plate and said link and said lever.

12. The locking mechanism according to claim 11 further comprising a recess in said bottom portion of said container, said sliding plate, said lever and said link being arranged for movement within said recess.

13. The locking mechanism according to claim 12 further comprising opposed ridges located adjacent said recess.

14. A locking arrangement comprising:

a container having a top portion and a bottom portion, said bottom portion having a side surface and a recess formed therein;

a sliding plate being slidably coupled to said bottom portion for movement toward and away from said top portion and disposed in said recess;

a lever being pivotally coupled to said bottom portion and disposed in said recess;

a link having a first end pivotally coupled to said sliding plate and a second end pivotally coupled to said lever;

a latch member having a first end and a second end, said first end being pivotally coupled to said sliding plate; and means associated with said top portion for cooperating with the second end of said latch member.

15. The locking arrangement of claim 14 further comprising a hinge that pivotally couples said first end of said latch member to said sliding plate.

16. The locking arrangement of claim 15 further comprising means coupled to said hinge for biasing the second end of said latch away from said top portion.

17. The locking arrangement of claim 16 wherein said means for biasing the second end of said latch away from said top portion comprises a spring.

18. The locking arrangement of claim 14 further comprising a cover plate that covers a portion of said sliding plate, lever and link.

19. The locking arrangement of claim 18 wherein said cover plate is generally coplanar with said side surface of said bottom portion.

20. The locking arrangement of claim 14 wherein said lever substantially overlaps said sliding plate.

21. A locking arrangement comprising a container having a top portion and a bottom portion, said bottom portion having a side surface and a recess formed therein;

a sliding plate being slidably coupled to said bottom portion and disposed in said recess for movement toward and away from said top portion;

a lever being pivotally coupled to said bottom portion and disposed in said recess;

a link having a first end pivotally coupled to said sliding plate and a second end pivotally coupled to said lever;

said lever, said sliding plate and said link being arranged to operate within said recess without extending substantially above a plane defined by said side surface;

a latch member having a first end and a second end, said first end being hingedly coupled to said sliding plate;

an engaging member being fixed to said top portion and having a configuration complementary to the second end of said latch;

said lever being rotatable between an open and a closed position, said link and said sliding plate cooperating with said lever to move said latch into locking engagement with said engaging member when said lever is moved to a locked position and to move said latch out of engagement with said complementary engaging member when said lever is moved to an unlocked position.

* * * * *